US012669116B2

(12) United States Patent
Salter et al.

(10) Patent No.: US 12,669,116 B2
(45) Date of Patent: Jun. 30, 2026

(54) POWER USAGE PLANNING SYSTEM AND METHOD FOR VEHICLE AIR COMPRESSOR

(71) Applicant: Ford Global Technologies, LLC, Dearborn, MI (US)

(72) Inventors: Stuart C. Salter, White Lake, MI (US); Brendan Diamond, Grosse Pointe, MI (US); Todd Ansbacher, Westland, MI (US); David Celinske, Wolverine Lake, MI (US); Vyas Darshan Shenoy, Canton, MI (US)

( * ) Notice: Subject to any disclaimer, the term of this patent is extended or adjusted under 35 U.S.C. 154(b) by 167 days.

(21) Appl. No.: 18/360,350

(22) Filed: Jul. 27, 2023

(65) Prior Publication Data

US 2025/0035103 A1 Jan. 30, 2025

(51) Int. Cl.

| | |
|---|---|
| ***F04B 49/02*** | (2006.01) |
| ***F04B 35/06*** | (2006.01) |
| ***F04B 41/02*** | (2006.01) |

(52) U.S. Cl.

CPC ..... *F04B 49/02* (2013.01); *F04B 35/06* (2013.01); *F04B 41/02* (2013.01); *F04B 2207/042* (2013.01)

(58) Field of Classification Search

None

See application file for complete search history.

(56) References Cited

U.S. PATENT DOCUMENTS

| | | | | |
|---|---|---|---|---|
| 8,939,240 | B2 * | 1/2015 | Wehrwein | B60W 10/30 180/53.8 |
| 10,543,735 | B2 * | 1/2020 | Colavincenzo | B60L 58/15 |
| 2006/0045749 | A1 * | 3/2006 | Beckman | F04B 49/065 417/1 |
| 2006/0045751 | A1 * | 3/2006 | Beckman | F04B 41/02 417/44.2 |

(Continued)

FOREIGN PATENT DOCUMENTS

| | | | | |
|---|---|---|---|---|
| CN | 105986916 A | * | 10/2016 | B60H 1/004 |
| CN | 112219098 A | * | 1/2021 | B65D 88/121 |

OTHER PUBLICATIONS

Translation of CN-105986916 Suzuki (Obtained from USPTO Search) (Year: 2025).*

(Continued)

*Primary Examiner* — Dominick L Plakkoottam
*Assistant Examiner* — Geoffrey S Lee
(74) *Attorney, Agent, or Firm* — Frank Lollo; Eversheds Sutherland (US) LLP

(57) ABSTRACT

A system and method to control operation of an air compressor of a vehicle is disclosed. The system may include a transceiver and a processor communicatively coupled with each other. The transceiver may be configured to receive vehicle information from a vehicle control unit. The vehicle information may include a vehicle type and real-time vehicle operational parameters. The processor may obtain the vehicle information from the transceiver and determine that a predefined condition may be met based on the vehicle type (Continued)

and the real-time vehicle operational parameters. The processor may further control an air compressor operation based on the vehicle type and the real-time vehicle operational parameters, responsive to determining that the predefined condition may be met.

2 Claims, 5 Drawing Sheets

(56) References Cited

U.S. PATENT DOCUMENTS

2006/0045752 A1* 3/2006 Beckman ..... F04B 49/065 417/44.2
2009/0288849 A1* 11/2009 Iimura ..... F04B 49/065 173/11
2010/0158702 A1* 6/2010 Colavincenzo ..... B60L 50/90 417/364
2010/0306033 A1* 12/2010 Oved ..... G07F 15/003 705/14.1
2011/0031050 A1* 2/2011 Bradley ..... G08G 1/096741 180/65.21
2011/0257824 A1* 10/2011 Couchene ..... B60K 26/00 903/902
2012/0290161 A1* 11/2012 Takeda ..... B60L 1/00 903/930
2013/0047648 A1* 2/2013 Zeigler ..... B60H 1/00428 62/133
2013/0204472 A1* 8/2013 Pfefferl ..... B60W 20/00 701/22
2013/0204490 A1* 8/2013 Pfefferl ..... B60L 3/108 701/36
2016/0202719 A1* 7/2016 Lippman ..... B60T 8/3255 74/513
2018/0001739 A1* 1/2018 Vehr ..... F25D 29/003
2020/0247211 A1* 8/2020 Devendran ..... F16D 61/00
2021/0107324 A1* 4/2021 Kalyanaraman ..... B60C 23/06
2022/0413523 A1* 12/2022 Yan ..... B01D 53/263
2023/0193813 A1* 6/2023 Dahl ..... F04B 35/008 417/46
2023/0347854 A1* 11/2023 Subramanian ..... B60T 17/22
2025/0035103 A1* 1/2025 Salter ..... F04B 35/06
2025/0035104 A1* 1/2025 Salter ..... F04B 35/06

OTHER PUBLICATIONS

Translation CN-112219098 Chopko (Obtained from USPTO Search) (Year: 2025).*
Sherin Sam Jose et al., Electric Vehicle Air Conditioning System and Its Optimization for Extended Range—A Review, World Electric Vehicle Journal, vol. J, Nov. 1, 2022, pp. 1-41.
Chien-Lun Weng et al., Design and Implementation of a Low-Energy-Consumption Air-Conditioning Control System for Smart Vehicle, Journal of Healthcare Engineering, vol. 2019, Article ID 3858560, Aug. 27, 2019, pp. 1-15.

* cited by examiner

POWER USAGE PLANNING SYSTEM AND METHOD FOR VEHICLE AIR COMPRESSOR

FIELD

The present disclosure relates to a vehicle having an in-built air compressor and more particularly to a power usage planning system and method for controlling operation of the in-built vehicle air compressor.

BACKGROUND

Many modern vehicles used for off-road or sporting purposes include features that enable users to use their vehicles for a plurality of activities apart from just transportation. For example, modern trucks or Sport Utility Vehicles (SUVs) enable recreational or utility tools to be connected to and powered by the vehicles.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
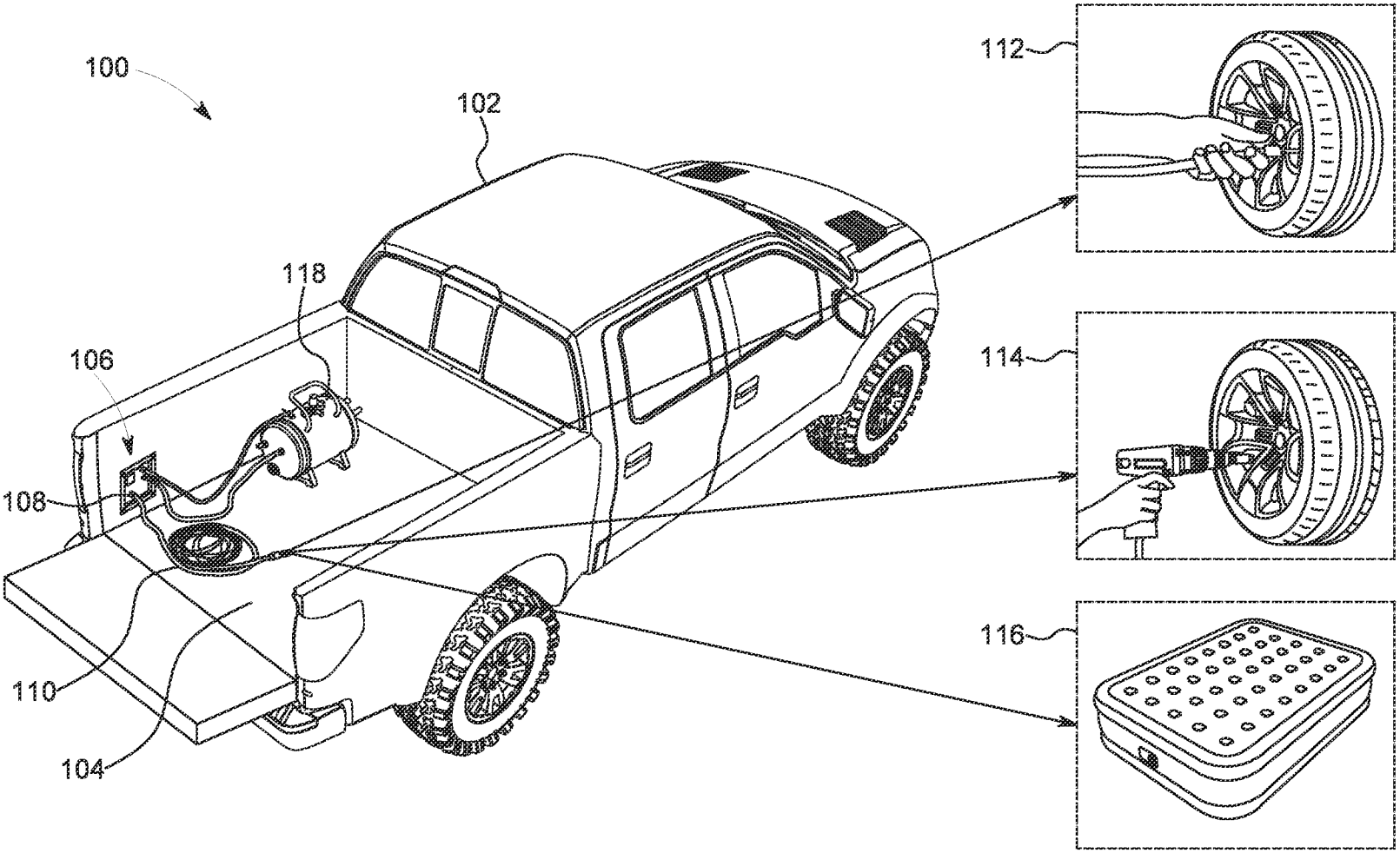
FIG. 1 depicts an exemplary environment in which techniques and structures for providing the systems and methods disclosed herein may be implemented.

The present disclosure describes a system and method to control operation of an air compressor of a vehicle. The air compressor may include a buffer tank or an air storage tank that may be configured to store compressed air that may be supplied by the air compressor when the air compressor may be operational/powered. A user may connect an external tool, e.g., a nail gun, a tire inflator, and/or a wrench, to a vehicle user interface panel and receive compressed air from the air storage tank to operate the tool. The system may be configured to control air compressor operation based on vehicle type and real-time vehicle operational parameters to ensure that the user may conveniently operate the tool and vehicle's battery energy consumption required for air compressor operation may be optimized.

In some aspects, when the vehicle is an Electric Vehicle (EV) and the vehicle is connected to an EV charger, the system may cause the air compressor to fill the air storage tank with compressed air to a maximum storage tank capacity (e.g., 150 Pound-force per square inch (psi)). On the other hand, when the vehicle is not connected to the EV charger (and operating by using the vehicle's High Voltage (HV) battery) and the system obtains a request from a user to operate the air compressor (i.e., to operate the tool), the system may cause air compressor operation to fill the air storage tank with compressed air at a level that may be required to operate the tool and not to the maximum storage tank capacity. In this manner, the system conserves the HV battery's energy by not enabling the air compressor to operate for a long time duration to fill the air storage tank to the maximum storage tank capacity.

In additional aspects, the system may determine a real-time vehicle battery State of Charge (SoC) when the air compressor may be operating using HV battery's energy. Responsive to determining the real-time vehicle battery SoC, the system may determine and output an expected remaining vehicle range (e.g., based on historical vehicle usage and driving pattern) via an audible or visual notification. The user may view/hear the notification and may decide to continue operating the air compressor or stop air compressor operation based on the expected remaining vehicle range.

In further aspects, when the vehicle may be an ICE vehicle, the system may operate the air compressor (e.g., at full capacity) when the vehicle engine may be operational/running and load shedding may not be operational responsive to obtaining a request from the user to operate the air compressor. If load shedding may be operational, the system may prioritize loads (e.g., shut off the steering wheel heater or one or more sitting area heaters, etc.) to accommodate the air compressor operation.

On the other hand, when the vehicle engine may not be operational/running and the system obtains an air compressor operation request from the user, the system may operate the air compressor for a predefined time duration, depending on the SoC of the vehicle battery (e.g., 12V battery). The system may also determine and output (via audible and/or visual notifications) expected time duration for which the air compressor may operate based on the vehicle battery SoC so that the user may decide to continue operating or stopping the air compressor.

In further aspects, the system may control air compressor operation based on a geographical area where the vehicle may be located or travelling. For example, the system may disable the air compressor and/or cause the air compressor to reduce air storage tank pressure to a predefined low pressure (e.g., close to 0 psi) when the vehicle may be travelling on a highway. On the other hand, the system may cause the air compressor to operate at full capacity when the vehicle may be a work vehicle and located/operating at a work site (e.g., a construction site).

In additional aspects, when the vehicle is an ICE vehicle and the user is operating the tool to perform a task by using the compressed air supplied by the air compressor, the system may determine an expected time duration the air compressor may be required to operate to enable the user finish the task based on the type of the tool used by the user and the task being performed. Responsive to determining the expected time duration, the system may determine and output (via audible and/or visual notifications) one or more recommendations to assist the user in operating the air compressor while optimizing vehicle battery energy usage. For example, based on the expected time duration, a current vehicle battery SoC, and an amount of compressed air stored in the air storage tank, the system may recommend to either use only the compressed air stored in the air storage tank, operate the air compressor by using the 12V battery, and/or operate the air compressor by using power drawn from the vehicle engine.

The present disclosure discloses a system and method to control operation of an air compressor of a vehicle. Based on the vehicle type, the system controls air compressor operation to optimize vehicle energy consumption. Specifically, the system prefills the buffer tank/air storage tank to full capacity when the vehicle may be getting charged via an EV charger (when the vehicle may be an EV) or when the vehicle engine may be operating at the worksite (when the vehicle may be an ICE vehicle). In this manner, the system ensures that the air compressor may not have to operate at full capacity when the air compressor may be operating using energy drawn from the vehicle battery, thus conserving battery energy. Further, the system disables air compressor operation at specific geolocations (e.g., highways) where vehicle energy may be required for other vehicle functions/features, thus optimizing vehicle energy consumption.

Illustrative Embodiments

The disclosure will be described more fully hereinafter with reference to the accompanying drawings, in which embodiments of the disclosure are shown, and are not intended to be limiting.

FIG. 1 depicts an environment 100 in which techniques and structures for providing the systems and methods disclosed herein may be implemented. The environment 100 may include a vehicle 102 that may take the form of any passenger or commercial vehicle such as, for example, a car, a work vehicle, a crossover vehicle, a truck, a van, a minivan, a taxi, a bus, etc. In the exemplary aspect depicted in FIG. 1, the vehicle 102 is a truck. The vehicle 102 may be a manually driven vehicle and/or may be configured to operate in a partially autonomous mode and may include any powertrain such as, for example, a gasoline engine, one or more electrically-actuated motor(s), a hybrid system, etc. Stated another way, the vehicle 102 may be an Internal Combustion Engine (ICE) vehicle or an Electric Vehicle (e.g., a Battery Electric Vehicle (BEV) or a plug-in hybrid electric vehicle (PHEV)) or a hybrid.

The vehicle 102 may include a truck bed 104 that may be configured to store one or more objects, equipment, etc. The vehicle 102 may further include an air compressor (shown as air compressor 210 in FIG. 2) with a built-in or attached buffer tank or an air storage tank (shown as air storage tank 212 in FIG. 2). The air compressor may supply compressed air to the air storage tank when the air compressor may be operational/powered, and the air storage tank may be configured to store the compressed air supplied by the air compressor. In some aspects, the air compressor and the air storage tank may be packaged under the truck bed 104 or inside a truck bed side wall. In other aspects, the air compressor and the air storage tank may be packaged at any other location in the vehicle 102.

In some aspects, if the vehicle 102 is an Electric Vehicle (EV), the air compressor may be powered by using vehicle's battery energy (e.g., by using the vehicle's High Voltage (HV) battery). On the other hand, if the vehicle 102 is an ICE vehicle, the air compressor may be powered by using power drawn from the vehicle engine (e.g., vehicle alternator) and/or energy drawn from the vehicle battery (e.g., a 12V vehicle battery). In additional aspects, if the vehicle 102 supports regenerative braking, a portion of energy generated through regenerative braking may be used to power the air compressor (e.g., when the vehicle battery may be fully charged).

The air compressor and the air storage tank may be in fluid communication with a panel 106 (or a user interface console) that may be installed on the vehicle 102. In the exemplary aspect depicted in FIG. 1, the panel 106 is installed on a truck bed side wall. The panel 106 may receive the compressed air from the air storage tank and may supply the compressed air to external tools, accessories, etc. A user (not shown) may connect an external tool/accessory with the panel 106 to receive the compressed air from the air storage tank.

Specifically, an outlet 108 of the panel 106 may be attached to a conduit 110 that may supply the compressed air from the air storage tank. The user may attach an external tool/accessory to the conduit 110 to receive the compressed air from the air storage tank to perform one or more tasks. For example, the user may inflate or deflate a tire by using the compressed air, as shown in view 112 in FIG. 1. Further, the user may use a power tool (e.g., a nail gun) by using the compressed air, as shown in view 114. Furthermore, the user may use the compressed air to inflate an air mattress, as shown in view 116. Use case examples depicted in FIG. 1 are for illustrative purposes and should not be construed as limiting the present disclosure scope. The user may use the compressed air received from the air storage tank for a plurality of other tasks (e.g., cleaning debris, operating a wrench, etc.) that is not depicted in FIG. 1.

In some aspects, the vehicle 102 may further include a power usage planning system or a compressor control system (shown as compressor control system 218 in FIG. 2) that may control air compressor operation based on a vehicle type and real-time vehicle operational parameters to optimize vehicle energy consumption. Specifically, the compressor control system ("system") may control air compressor operation to ensure that the air compressor is operated at specific time durations (and not always) or only when predefined conditions are met to ensure that substantial vehicle battery energy is not consumed to operate the air compressor. In some aspects, the system may control or change air compressor operational modes based on whether the vehicle 102 is an EV or an ICE vehicle, whether the vehicle 102 is connected to an electric charger or operating on HV battery if the vehicle 102 is an EV, whether the vehicle engine is operational/running and load shedding is operational if the vehicle is an ICE vehicle, and/or the like. The process of controlling air compressor operation based on vehicle type and real-time vehicle operational parameters is described later in detail below in conjunction with FIG. 2.

In some aspects, the system may be additionally configured to control air compressor operation based on a geographical area (a highway, a worksite, etc.) in which the vehicle 102 may be located or travelling. For example, the system may disable the air compressor operation (i.e., not power the air compressor) when the vehicle 102 may be travelling on a highway and may operate the air compressor at full capacity to fill the air storage tank (e.g., till a maximum storage tank capacity of 150 Pound-force per square inch (psi)) when the vehicle 102 may be located at a worksite.

In further aspects, the system may be configured to estimate a time duration the air compressor may be required to operate to enable the user optimally complete the task that the user may be performing by using the external tool, based on the type of the external tool attached to the outlet 108/conduit 110 and the type of the task being performed.

For example, the system may estimate that the air compressor may be required to operate for a long time duration when the user may be using an air sander and may be required to operate for a relatively shorter time duration when the user may be filling a tire by using the external tool.

Responsive to estimating the time duration, the system may output an audio or visual notification (e.g., via a vehicle infotainment system, vehicle speakers, etc.) indicating the estimated time. The system may further output a recommendation to a user device/vehicle infotainment system indicating whether the user may operate the external tool by using only the compressed air stored in the external storage tank, by using the compressed air stored in the external storage tank and operating the air compressor by using the vehicle battery (e.g., 12V battery), or by running/activating the vehicle engine and operating the air compressor by using power drawn from the vehicle engine. Responsive to receiving the recommendation, the user may operate the external tool based on the received recommendation.

In additional aspects, the system may enable the user to optionally connect one or more external storage tanks 118 to the panel 106 to receive and/or provide the compressed air. The user may connect the external storage tank 118 to the panel 106 when, for example, the user may be in need of additional amount of compressed air (over and above the amount of compressed air that the in-built air storage tank may provide). In some aspects, the system may control flow of compressed air to/from the external storage tank 118, in addition to controlling the air compressor operation.

Functions details of the system are described below in conjunction with FIG. 2.

The vehicle 102, the compressor control system and/or the user may implement and/or perform operations, as described here in the present disclosure, in accordance with the owner manual and safety guidelines.

Figure 2:
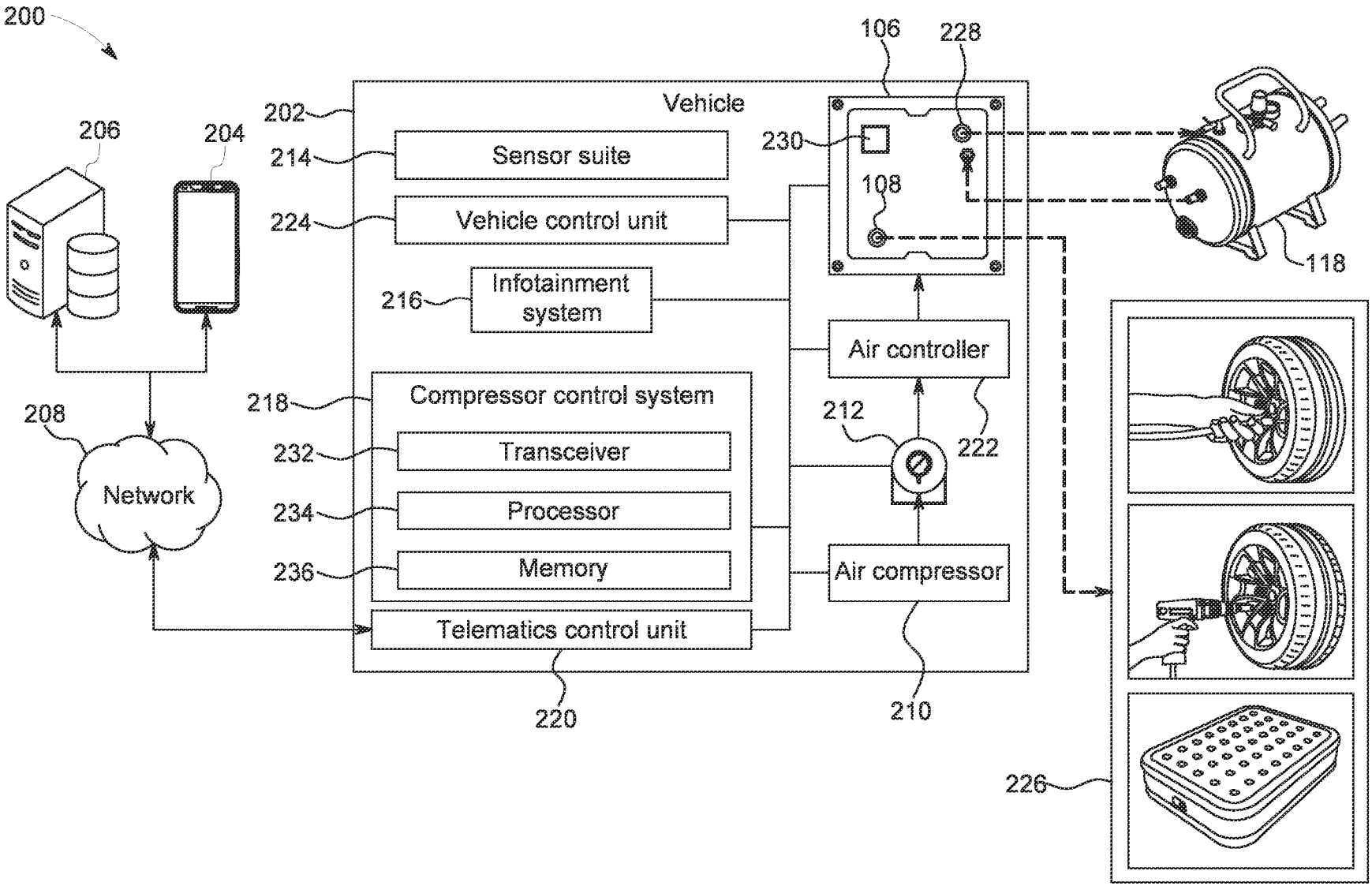
FIG. 2 depicts a block diagram of an exemplary system to control operation of a vehicle air compressor in accordance with the present disclosure.

FIG. 2 depicts a block diagram of a system 200 to control operation of a vehicle air compressor in accordance with the present disclosure. While describing FIG. 2, references may be made to FIGS. 3 and 4.

The system 200 may include a vehicle 202, which may be same as the vehicle 102 described above in conjunction with FIG. 1. The system 200 may further include a user device 204 and one or more server(s) 206 communicatively coupled with the vehicle 202 via one or more network(s) 208. The user device 204 may be associated with a vehicle user and may include a mobile device, a tablet, a laptop, a smart watch, or any other device with communication capabilities.

The server(s) 206 may be configured to store information associated with a plurality of tools and a plurality of tasks that may be performed by using the tools. The tools may include, but are not limited to, nail guns, airbrushes, wrenches, tire inflators, and/or the like. The tasks that may be performed by using the tools may include, but are not limited to, inflating air mattresses, inflating and/or deflating tires, blowing debris, winterization, and/or the like. In some aspects, the information associated with the plurality of tools and tasks stored in the server(s) 206 may include an expected operational time duration of each tool for one or more tasks, an expected amount of air (e.g., maximum, minimum air pressure and/or desired operating pressure range) that may be required to perform one or more tasks by each tool, and/or the like. For example, the server(s) 206 may store information associated with an expected time duration and/or air pressure a tire inflator may take/require to fill a bicycle tire or a truck tire. A person ordinarily skilled in the art may appreciate that the time duration and/or the required air pressure may vary based on whether the task being performed is a quick transient task (e.g., filling a tire) or a sustained usage task (e.g., using an air sander). In some aspects, the server(s) 206 may transmit the information associated with the plurality of tools and the plurality of tasks to the vehicle 202 at a predefined frequency. In other aspects, the server(s) 206 may transmit the information to the vehicle 202 when the vehicle 202 sends a request to the server(s) 206 seeking the information.

The network(s) 208 illustrates a communication infrastructure in which the connected devices discussed in various embodiments of this disclosure may communicate. The network(s) 208 may be and/or include the Internet, a private network, public network or other configuration that operates using any one or more known communication protocols such as, for example, transmission control protocol/Internet protocol (TCP/IP), Bluetooth®, BLE®, Wi-Fi based on the Institute of Electrical and Electronics Engineers (IEEE) standard 802.11, ultra-wideband (UWB), and cellular technologies such as Time Division Multiple Access (TDMA), Code Division Multiple Access (CDMA), High-Speed Packet Access (HSPDA), Long-Term Evolution (LTE), Global System for Mobile Communications (GSM), and Fifth Generation (5G), to name a few examples.

The vehicle 202 may include a plurality of units including, but not limited to, an air compressor 210 having an in-built or an attached air storage tank 212, a sensor suite 214, an infotainment system 216, a compressor control system 218, a telematics control unit (TCU) 220, an air controller 222, a vehicle control unit 224 and the panel 106. The plurality of units may be communicatively coupled with each other via wired (e.g., via a bus) or wireless communication connections. As described above in conjunction with FIG. 1, the user may optionally attach the external storage tank 118 to the panel 106, when the user requires additional compressed air.

As described above in conjunction with FIG. 1, the air compressor 210 may be configured to supply compressed air to the air storage tank 212. The air storage tank 212 may receive the compressed air from the air compressor 210 and may store the compressed air, which may be provided to an external tool via the outlet 108 based on tool usage requirements (as shown in view 226 of FIG. 2). In some aspects, the compressor control system 218 (or system 218) may control flow of compressed air from the air storage tank 212 to the external tool by using the air controller 222. Specifically, the air controller 222 may receive inputs from the system 218 to control the flow of compressed air from the air storage tank 212 to the outlet 108 and hence to the external tool.

The panel 106 may include a plurality of components including, but not limited to, the outlet 108, external tank outlet and inlet 228, a display 230, one or more air pressure knobs/buttons, start/stop buttons, a power socket (not shown), and/or the like. The external tank outlet and inlet 228 may enable the user to connect the external storage tank 118 with the panel 106. The display 230 may display operational parameters of the air compressor 210 and/or the air storage tank 212 (e.g., air pressure, cfm, etc.). The start/stop buttons may enable the user to manually start or stop air compressor operation, and the air pressure knobs/buttons may enable the user to input a desired air pressure. The power socket may be used by the user to power any external device (if required).

In some aspects, the user may additionally start/stop the air compressor operation and provide additional air compressor operational inputs to the vehicle 202 via the infotainment system 216 and/or the user device 204 (that may transmit the inputs to the vehicle 202 via the network 208).

For example, the user may input the desired air pressure and/or an air compressor operational mode on the infotainment system 216 and/or the user device 204. The air compressor operational mode may include, for example, an inflation mode in which the user may input a target air pressure, and the air supply from the air storage tank 212 may be automatically shut off by the system 218 (via the air controller 222) when the target air pressure may be reached. As another example, the air compressor operational mode may include a continuous air mode in which the compressed air may be continuously provided from the air storage tank 212 to the external tool, and the user may control the air pressure via the air pressure knobs/buttons.

In additional aspects, the user may provide details of the external tool (e.g., model, brand, etc.) and/or the task being performed by the user (e.g., inflating air mattresses, inflating and/or deflating tires, blowing debris, winterization, and/or the like) to the vehicle 202 via the infotainment system 216 and/or the user device 204.

The TCU 220 may be configured and/or programmed to provide vehicle connectivity to wireless computing systems onboard and off board the vehicle 202, and may include a Navigation (NAV) receiver for receiving and processing a GPS signal, a BLE® Module (BLEM), a Wi-Fi transceiver, a UWB transceiver, and/or other wireless transceivers (not shown in FIG. 2) that may be configurable for wireless and cellular communication between the vehicle 202 and other systems (e.g., the user device 204, the server 206, etc.), computers, and modules. The TCU 220 may also enable the system 218 to wirelessly connect (e.g., via BLE or UWB) with one or more vehicle components, e.g., the panel 106, the air compressor 210, the air controller 222, the sensor suite 214, and/or the like. The TCU 220 may be further configured to determine vehicle geolocation based on the GPS signals received by the TCU 220.

The sensor suite 214 may include one or more sensors (not shown) including, but not limited to, interior/exterior/Center High Mounted Stop Lamp (CHMSL) cameras, radar sensor(s), lidar sensor(s), a tank pressure sensor, an outlet valve pressure sensor, temperature sensors, weight sensors (not shown), and/or the like. In some aspects, the tank pressure sensor may be configured to measure a real-time air pressure in the air storage tank 212 and the outlet valve pressure sensor may be configured to measure real-time tool usage air pressure at which the external tool may be operating (or the pressure of compressed air output from the outlet 108). In some aspects, the infotainment system 216 may be part of the sensor suite 214. In other aspects, the infotainment system 216 may be separate from the sensor suite 214, as shown in FIG. 2.

The vehicle control unit 224 may include a plurality of vehicle Electronic Control Units (ECUs) and may be programmed to coordinate data between vehicle systems, connected servers (e.g., the server(s) 206), and other vehicles (not shown in FIG. 2) operating as part of a vehicle fleet. In some aspects, the vehicle control unit 224 may be configured to control one or more vehicle operations, e.g., activating/deactivating vehicle lights, heating, ventilation, and air conditioning (HVAC) system, controlling vehicle door movement, etc. In additional aspects, the vehicle control unit 224 may be configured to determine vehicle information including a vehicle type (e.g., whether the vehicle 202 is an EV or ICE vehicle) based on powertrain architecture type, vehicle model, real-time vehicle operational parameters, etc. Examples of the real-time vehicle operational parameters include, but are not limited to, vehicle speed, whether the vehicle engine (if the vehicle 202 is an ICE vehicle) is operational/running or not, whether the vehicle 202 is connected to an EV charger (if the vehicle 202 is an EV), real-time vehicle battery state of charge (SoC), and/or the like. The vehicle control unit 224 may transmit the vehicle information to the system 218 at a predefined frequency, or may transmit the vehicle information to the system 218 when the system 218 sends a request to the vehicle control unit 224 seeking the vehicle information.

In some aspects, the system 218 may be part of a vehicle automotive computer (not shown) and may be installed in a vehicle engine compartment (or elsewhere in the vehicle 202). The system 218 may include a transceiver 232, one or more processor(s) 234 and a memory 236. The transceiver 232 may be configured to receive information/data from external systems (e.g., the user device 204, the server(s) 206, and/or the like) via the network 208 or vehicle internal systems (e.g., the sensor suite 214, the infotainment system 216, the TCU 220, the vehicle control unit 224, and/or the like). The transceiver 232 may be further configured to transmit information/data/notifications/command signals to the external systems and/or the vehicle internal systems (e.g., the air controller 222, the air compressor 210, the panel 106, the infotainment system 216, and/or the like).

The processor(s) 234 may be disposed in communication with one or more memory devices disposed in communication with the respective computing systems (e.g., the memory 236 and/or one or more external databases not shown in FIG. 2). The processor(s) 234 may utilize the memory 236 to store programs in code and/or to store data for performing aspects in accordance with the disclosure. The memory 236 may be a non-transitory computer-readable memory storing an air compressor control program code. The memory 236 can include any one or a combination of volatile memory elements (e.g., dynamic random-access memory (DRAM), synchronous dynamic random-access memory (SDRAM), etc.) and can include any one or more nonvolatile memory elements (e.g., erasable programmable read-only memory (EPROM), flash memory, electronically erasable programmable read-only memory (EEPROM), programmable read-only memory (PROM), etc.).

In some aspects, the memory 236 may be configured to store information/inputs received from the sensor suite 214, the infotainment system 216, the vehicle control unit 224, the user device 204 and the server(s) 206 (via the transceiver 232).

The system architecture of the vehicle 202, as depicted in FIG. 2, may omit certain computing, electronics and/or mechanical modules. It should be readily understood that the architecture depicted in FIG. 2 is an example of a possible implementation according to the present disclosure, and thus, it should not be considered limiting or exclusive.

In operation, the transceiver 232 may receive the vehicle information from the vehicle control unit 224, the information associated with the plurality of tools and the plurality of tasks from the server(s) 206, one or more user inputs from the infotainment system 216 and/or the user device 204, inputs from the sensor suite 214 and/or air compressor activation request from the infotainment system 216, the user device 204 and/or the panel 106. Responsive to receiving the information/inputs described above, the transceiver 232 may send the received information/inputs to the memory 236 for storage purpose.

The processor 234 may obtain the information/inputs described above from the memory 236 or directly from the transceiver 232. Responsive to obtaining the information/inputs, the processor 234 may determine whether a predefined condition, of a plurality of predefined conditions, may be met based on the obtained information. The processor 234 may control air compressor operation in different ways/manners responsive to determining that a predefined condition may be met and based on a type of the predefined condition that may be met. For example, based on the vehicle type and the real-time vehicle operational parameters, the processor 234 may determine whether a predefined condition is met. Responsive to determining that the predefined condition is met, the processor 234 may activate the air compressor 210 automatically and/or control time duration of air compressor operation based on the vehicle type and the real-time vehicle operational parameters. The description below describes examples of different controls the processor 234 executes on the air compressor 210 based on the obtained information/inputs. The present disclosure is not limited to the examples described below.

Figure 3:
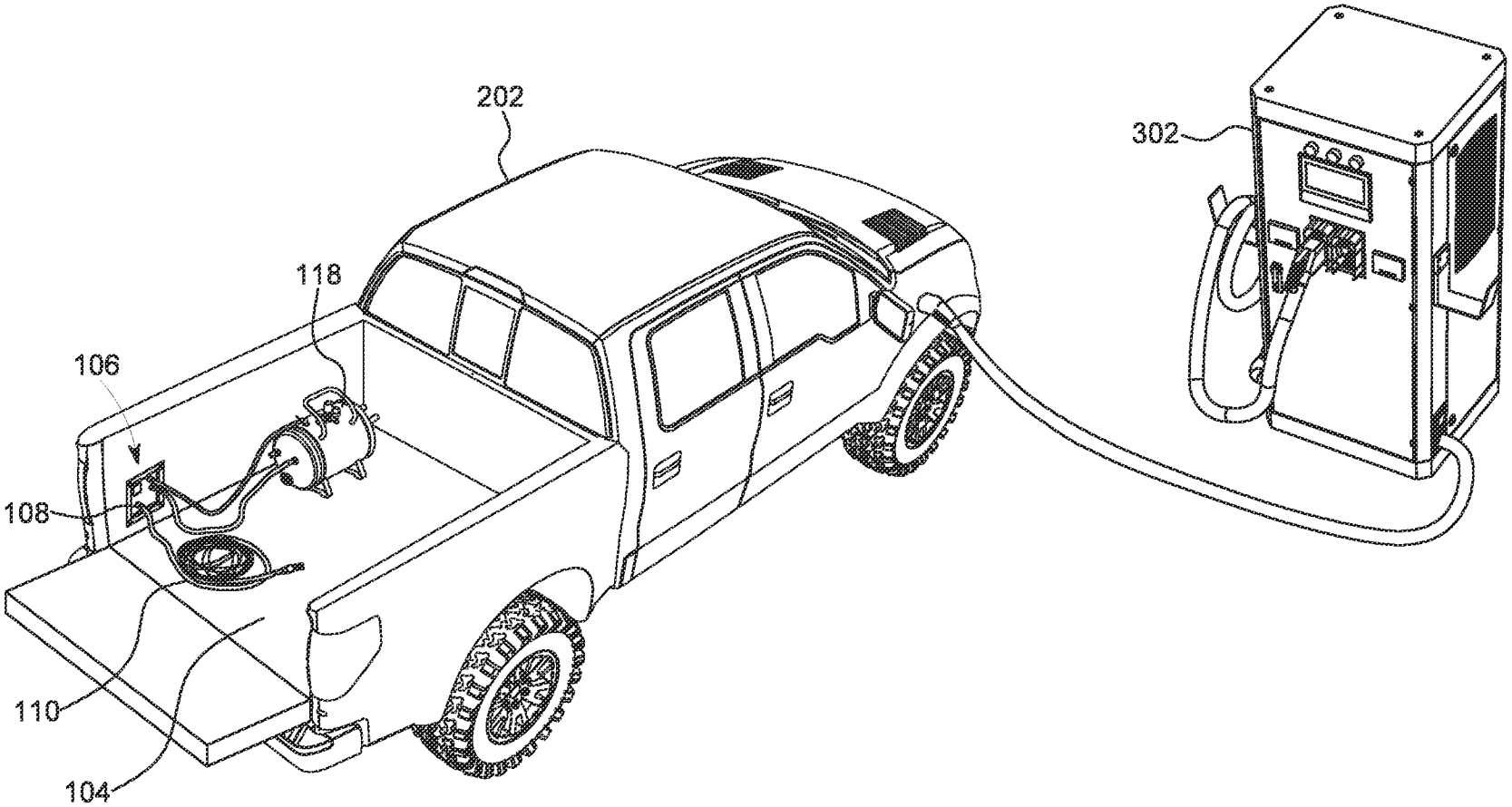
FIG. 3 depicts an exemplary electric vehicle connected to an electric charger in accordance with the present disclosure.

In some aspects, the processor 234 may determine that the vehicle 202 may be an EV (i.e., the vehicle type may be EV) based on the vehicle information obtained from the vehicle control unit 224. In other aspects, the processor 234 may determine that the vehicle 202 may be an EV based on vehicle type information that may be pre-stored in the memory 236. Responsive to determining that the vehicle 202 may be an EV, the processor 234 may determine that a first predefined condition may be met whenever the vehicle 202 may be connected to an EV charger 302 (as shown in FIG. 3). The processor 234 may activate the air compressor 210 automatically and cause the air compressor 210 to supply the compressed air to the air storage tank 212 when the processor 234 determines that the vehicle 202 is an EV and the vehicle 202 may be getting charged via the EV charger 302. Specifically, in this case, whenever the vehicle 202 may be connected to the EV charger 302, the processor 234 may cause the air compressor 210 to fill the air storage tank 212 with compressed air at the maximum storage tank capacity (e.g., 150 psi). In this manner, the processor 234 ensures that the air storage tank 212 or the "buffer tank" is completely filled with the compressed air when the vehicle 202 may be getting charged, so that the vehicle battery may not be utilized to fill the air storage tank 212 later (e.g., when the vehicle 202 may not be getting charged), thereby optimizing vehicle battery usage. If the vehicle 202 additionally has the external storage tank 118 connected to the panel 106, the processor 234 may cause air compressor operation to fill the external storage tank 118 with the compressed air to maximum capacity as well, in addition to filling up the air storage tank 212.

In further aspects, when the vehicle 202 may be an EV and the processor 234 obtains an air compressor activation request from the user (e.g., via the user device 204, the infotainment system 216 or the panel 106), the processor 234 may determine a current vehicle battery SoC based on the real-time vehicle operational parameters. The processor 234 may then compare the current vehicle battery SoC with a predefined SoC threshold (that may be pre-stored in the memory 236).

The processor 234 may further determine the type of the external tool that may be connected to the outlet 108 by the user and the type of task being performed by using the external tool, based on the obtained user inputs and/or inputs (e.g., images) obtained from the sensor suite 214 and by using one or more image processing algorithms (that may be pre-stored in the memory 236). Responsive to determining the external tool type and the task type, the processor 234 may correlate the determined tool/task type information with the information associated with the plurality of tools and the plurality of tasks obtained from the server(s) 206 to determine an expected desired operating pressure range of the compressed air required by the external tool to perform the task.

Responsive to determining that the battery SoC may be more than the predefined SoC threshold, the processor 234 may cause "normal" air compressor operation, in which the air compressor 210 may fill the air storage tank 212 with the compressed air at a first pressure that may be a first predefined percentage (e.g., 25-35%) greater than the expected desired operating pressure range.

On the other hand, responsive to determining that the battery SoC may be less than the predefined SoC threshold, the processor 234 may determine that a second predefined condition may be met. In this case, the processor 234 may cause an "optimized" air compressor operation, in which the air compressor 210 may fill the air storage tank 212 with the compressed air at a second pressure that may be a second predefined percentage (e.g., 0-10%) greater than the desired operating pressure range. The second predefined percentage may be substantially less than the first predefined percentage, thereby ensuring that the air compressor 210 does not have to operate for a long time duration, thus saving vehicle battery energy.

In further aspects, when the air compressor 210 may be operating in normal or optimized air compressor operation, the processor 234 may determine and track real-time vehicle battery SoC level. The processor 234 may further calculate an estimated remaining vehicle range based on the real-time vehicle battery SoC level and historical vehicle travel and energy consumption pattern (that may be pre-stored in the memory 236). Responsive to estimating the vehicle range, the processor 234 may output (via the infotainment system 216, the user device 204, a vehicle speaker, etc.) a notification including the estimated remaining vehicle range at a predefined frequency. The user may view/hear the notification and may decide to continue using the external tool (and hence operating the air compressor 210) or stop using the external tool, based on the estimated remaining vehicle range.

In further aspects, the processor 234 may determine that the vehicle 202 may be an ICE vehicle (i.e., vehicle type may be ICE vehicle) based on the vehicle information obtained from the vehicle control unit 224 or the vehicle type information that may be pre-stored in the memory 236. Responsive to determining that the vehicle 202 may be an ICE vehicle, the processor 234 may determine that a third predefined condition may be met when the processor 234 obtains the air compressor activation request from the user and the vehicle engine may be operational/running (determined based on real-time vehicle operational parameters). In some aspects, in this case, the processor 234 may further determine that the third predefined condition may be met when load shedding may not be operational in the vehicle 202.

Responsive to determining that the third predefined condition may be met, the processor 234 may cause the air compressor 210 to fill the air storage tank 212 with the compressed air at a third pressure. The third pressure may be same as the maximum storage tank capacity (e.g., 150 psi) of the air storage tank 212 or may be equivalent to the first pressure described above.

In some aspects, when the load shedding may be operational, the processor 234 may be further configured to automatically prioritize load shedding, so that the air compressor 210 may be operated. For example, the processor 234 may stop operation of one or more vehicle functions/features (e.g., stop sitting area heater of one or more sitting areas, stop steering wheel heater, and/or the like) to accommodate air compression operation when load shedding may be operational. The processor 234 may prioritize load shedding based on user preferences (that may be pre-stored in the memory 236), real-time user inputs, or based on inputs obtained from the server(s) 206 and/or a vehicle fleet operator. In some aspects, the processor 234 may prioritize load shedding irrespective of the vehicle type. Stated another way, the processor 234 may prioritize load shedding when the vehicle 202 may be an EV or an ICE vehicle.

In further aspects, when the vehicle 202 may be an ICE vehicle and the processor 234 obtains the air compressor activation request, the processor 234 may determine that a fourth predefined condition may be met when the vehicle engine may not be operational (i.e., no power may be getting generated from the vehicle alternator). Responsive to determining that the fourth predefined condition may be met, the processor 234 may cause the air compressor operation for a predefined time duration. In some aspects, the predefined time duration may depend on a current vehicle battery (e.g., 12V battery) SoC. For example, the predefined time duration may be higher when the vehicle battery SoC may be greater than a predefined threshold, and the predefined time duration may be relatively lower when the vehicle battery SoC may be lower than the predefined threshold.

In additional aspects, when the air compressor 210 may be operating and the vehicle engine may not be running/operational, the processor 234 may calculate an estimated air compressor operation time duration based on a real-time vehicle battery SoC. Stated another way, the processor 234 may estimate an expected time duration for which the air compressor 210 may keep on operating based on the real-time vehicle battery SoC. Responsive to calculating the estimated air compressor operation time duration, the processor 234 may output (via the infotainment system 216, the user device 204, the vehicle speaker, etc.) a notification including the air compressor operation time duration at a predefined frequency. The user may view/hear the notification and may decide to continue using the external tool (and hence operating the air compressor 210) or stop using the external tool, based on the air compressor operation time duration.

In further aspects, when the processor 234 obtains the air compressor activation request and the vehicle 202 may be an ICE vehicle, the processor 234 may determine an expected time duration for which the air compressor 210 may be required to be operational, for the external tool to complete the task being performed. Specifically, as described above, the processor 234 may determine the type of the external tool connected to the outlet 108 by the user and the type of task being performed by using the external tool, based on the obtained user inputs and/or inputs (e.g., images) obtained from the sensor suite 214 and by using one or more image processing algorithms (that may be pre-stored in the memory 236). Responsive to determining the external tool type and the task type, the processor 234 may correlate the determined tool/task type information with the information associated with the plurality of tools and the plurality of tasks obtained from the server(s) 206 to determine an expected time duration for which the tool may be required to operate (and hence the air compressor 210 may be required to operate) to complete the task. For example, if the user may be inflating a vehicle tire, the processor 234 may estimate a time duration for which the tire inflator (and hence the air compressor 210) may be required to operate to fill the tire. In this case, the server(s) 206 and/or the memory 236 may pre-store information associated with tire size, pressure, etc.

Responsive to determining the expected time duration for air compressor operation or tool operation, the processor 234 may determine and provide one or more recommendations to the user, based on the expected time duration and the real-time vehicle operational parameters. For example, when the expected time duration may be less than a predefined time duration threshold and the air storage tank 212 may be filled to maximum storage tank capacity (e.g., 150 psi), the processor 234 may provide a first recommendation to operate the tool by using the compressed air stored in the air storage tank 212 and not operating/activating the air compressor 210. Stated another way, the processor 234 may recommend to use only the air storage tank 212 (and not switch ON the air compressor 210) when the air storage tank 212 may have enough stored compressed air to enable the tool to complete the task. In this case, the processor 234 may transmit the first recommendation to the user device 204, the infotainment system 216, and/or the like, and the user may view/hear the recommendation and may operate the tool based the first recommendation.

As another example, when the expected time duration may be greater than the predefined time duration threshold and/or if the air storage tank 212 may not have enough compressed air to enable the tool to complete the task, the processor 234 may check a current vehicle battery SoC (i.e., SoC of the 12V battery). The processor 234 may further calculate an expected vehicle battery SoC that may enable the air compressor 210 to operate for the time duration for which the tool may perform the task (based on historical operational information of the vehicle battery and the air compressor 210, which may be pre-stored in the memory 236). Responsive to calculating the expected vehicle battery SoC, the processor 234 may compare the current vehicle battery SoC with the expected vehicle battery SoC. The processor 234 may provide a second recommendation to the user when the current vehicle battery SoC may be equivalent to or greater than the expected vehicle battery SoC, and a third recommendation when the current vehicle battery SoC may be less than the expected vehicle battery SoC.

In some aspects, the second recommendation may include performing the task by using the compressed air stored in the air storage tank 212 and operating the air compressor 210 by using the vehicle battery (e.g., the 12V battery). The third recommendation may include operating or running the vehicle engine and performing the task by operating the air compressor 210 by drawing power from the vehicle engine. In this case, the vehicle engine may be operated till the vehicle battery SoC increases above the expected vehicle battery SoC. When the vehicle battery SoC increases above the expected vehicle battery SoC, the vehicle engine may be stopped and the air compressor 210 may operate by using energy drawn from the vehicle battery.

In further aspects of the present disclosure, the processor 234 may perform one or more power usage optimization actions, irrespective of whether the vehicle 202 may be an EV or an ICE vehicle. For example, the processor 234 may control air compressor operation based on vehicle geolocation (that the processor 234 may obtain from the TCU 220), historical vehicle operation pattern, inputs obtained from a fleet operator (when the vehicle 202 may be part of a vehicle fleet), and/or the like, as described below.

In some aspects, the processor 234 may obtain the vehicle geolocation based on the inputs obtained from the TCU 220 or the real-time vehicle operational parameters. Responsive to obtaining the vehicle geolocation, the processor 234 may determine whether the vehicle 202 may located in or travelling through predetermined geographical areas (information of which may be pre-stored in the memory 236). For example, the processor 234 may determine that the vehicle 202 may be travelling through a first geographical area (e.g., a highway) or may be entering or located in a second geographical area (e.g., a worksite if the vehicle 202 is part of a vehicle fleet operating in the worksite), based on the obtained vehicle geolocation. The processor 234 may perform a first predefined action, e.g., disable air compressor operation, when the vehicle 202 may be travelling through a highway to conserve vehicle energy and ensure that the vehicle battery is able to meet electric steering and/or braking system energy requirements.

Figure 4:
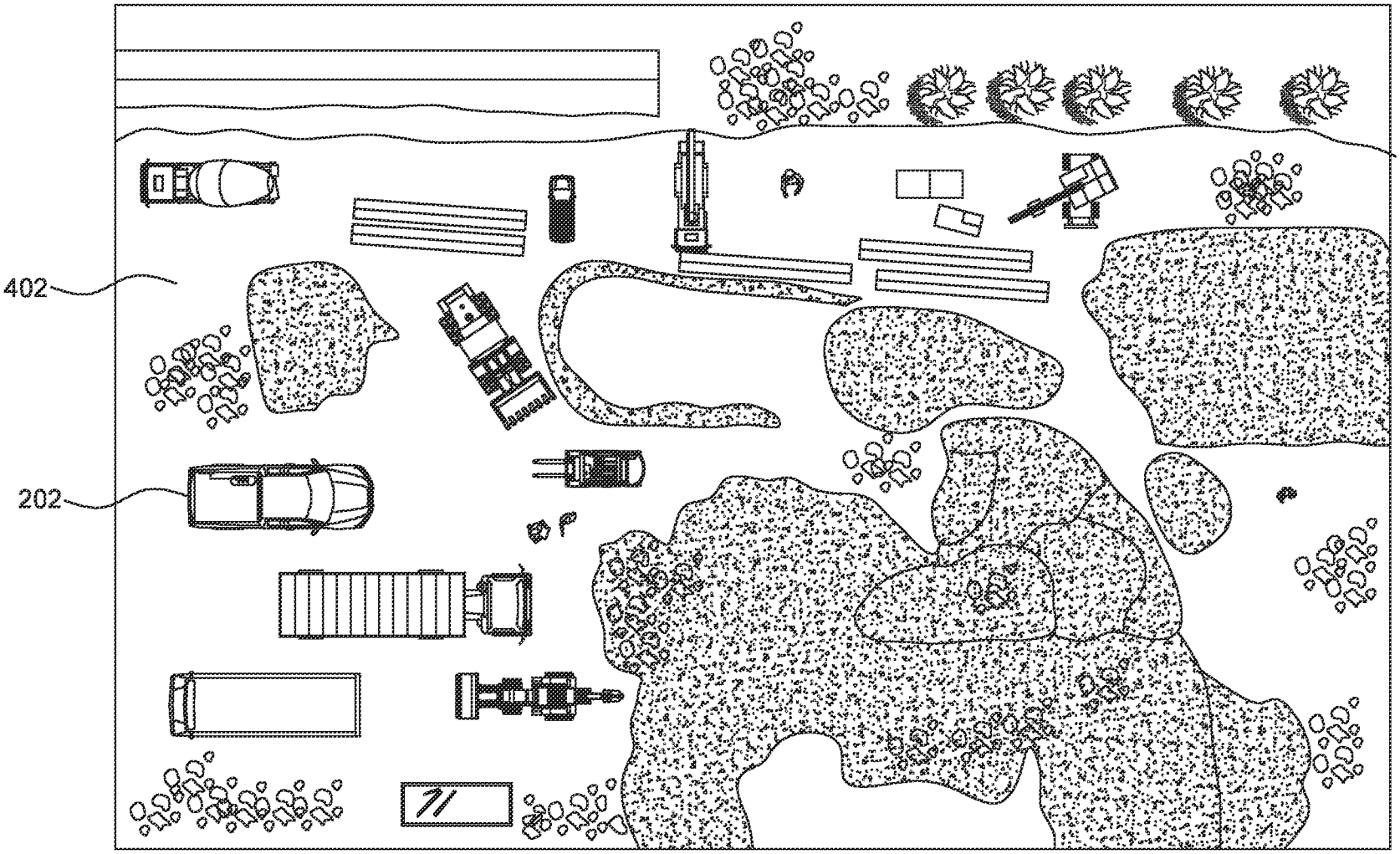
FIG. 4 depicts an exemplary vehicle entering a work site in accordance with the present disclosure.

On the other hand, the processor 234 may perform a second predefined action, e.g., operate the air compressor 210 at full capacity to fill the air storage tank 212 with the compressed air at maximum storage tank capacity (e.g., 150 psi), when the vehicle 202 may be entering or located in a worksite 402, as shown in FIG. 4. In this case, if the vehicle 202 additionally has the external storage tank 118 connected to the panel 106, the processor 234 may cause air compressor operation to fill the external storage tank 118 with the compressed air to maximum capacity as well, in addition to filling up the air storage tank 212. In some aspects, if the vehicle is an ICE vehicle, the processor 234 may cause the air compressor 210 to operate at full capacity when the vehicle engine may be operational (e.g., during working hours of the vehicle 202) and the vehicle 202 may be located in the worksite. This may ensure that when the vehicle 202 leaves the worksite, the air storage tank 212 (and the external storage tank 118, if attached) may be completely filled-up.

Furthermore, when the vehicle 202 may be a work vehicle that regularly uses the air compressor 210 (e.g., a stranded motorist assist vehicle, tow truck, construction vehicle, etc.), filling up the air storage tank 212 (and the external storage tank 118, if attached) may provide benefits to the driver/fleet operator when the vehicle 202 may need to use compressed air during work/vehicle operation.

In some aspects, the processor 234 may further pre-fill the air storage tank 212 (and the external storage tank 118, if attached) to maximum capacity when the vehicle 202 may be expected to travel to specific geographical areas where the user may need compressed air. For example, if the vehicle 202 is expected to travel through geographical areas where stranded motorists are regularly present, the processor 234 may pre-fill the air storage tank 212 (and the external storage tank 118, if attached) to maximum capacity. The processor 234 may also pre-fill the air storage tank 212 (and the external storage tank 118, if attached) to maximum capacity based on expected driving mode of the vehicle 202 at a planned trip. In some aspects, the processor 234 may determine the expected driving mode and/or the geographical areas where the vehicle 202 may travel based on user inputs and/or historical vehicle operation/travel pattern (that may be pre-stored in the memory 242). In further aspects, the processor 234 may cause the air compressor 210 to operate at full capacity when the vehicle 202 or the user may be providing compressed air to a stranded motorist (as determined via user inputs or inputs/images obtained via the sensor suite 214).

In additional aspects, the processor 234 may cause the air compressor 210 to reduce air storage tank pressure to a predefined low pressure (e.g., close to or equivalent to 0 psi) when a predefined low-pressure condition may be met. Examples of the predefined low-pressure condition may include, but are not limited to, driving off-road, encountering an adverse situation, driving on a highway, and/or the like.

Figure 5:
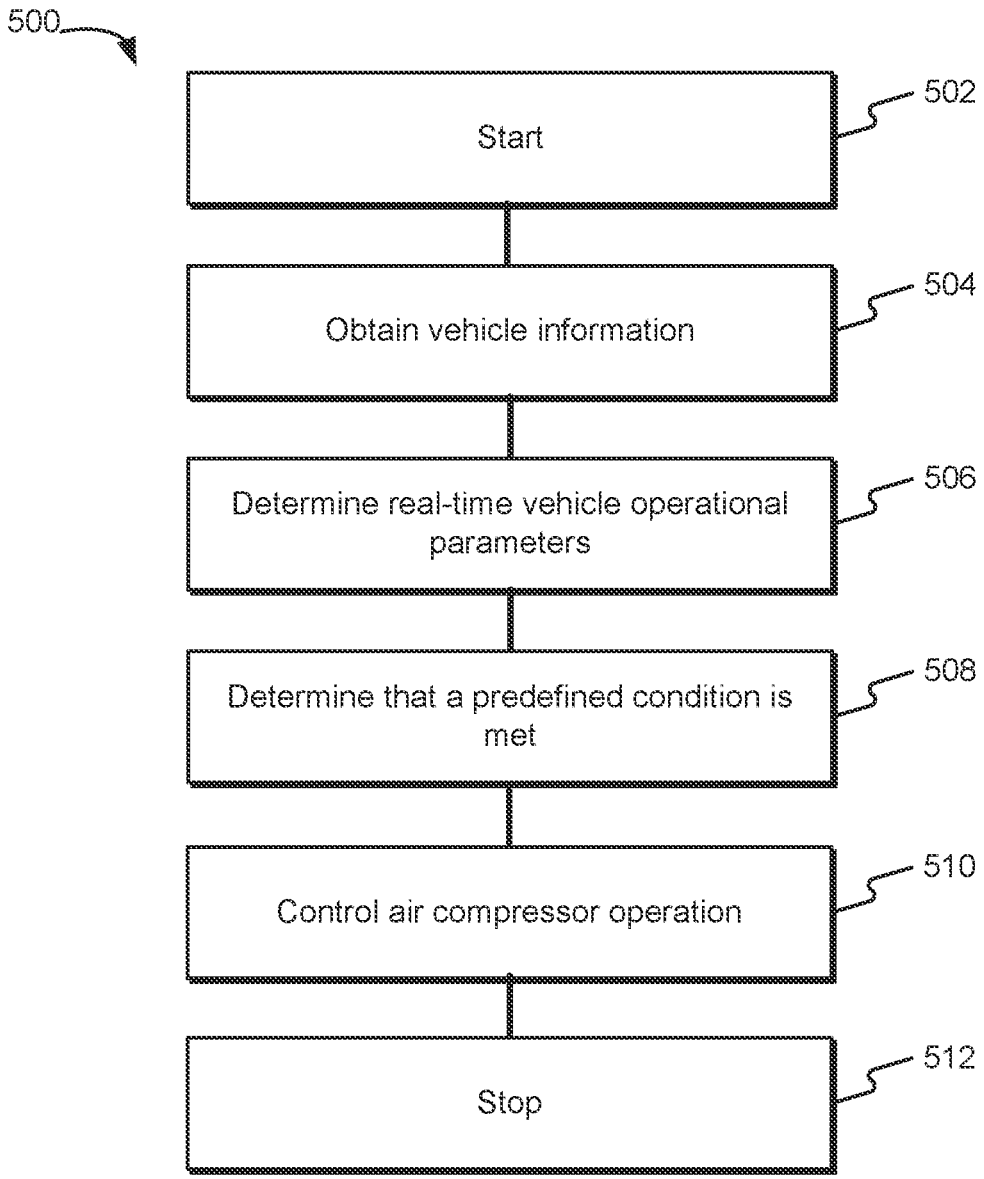
FIG. 5 depicts a flow diagram of an exemplary method to control operation of a vehicle air compressor in accordance with the present disclosure.

FIG. 5 depicts a flow diagram of an example method 500 to control operation of the air compressor 210 in accordance with the present disclosure. FIG. 5 may be described with continued reference to prior figures, including FIGS. 1-4. The following process is exemplary and not confined to the steps described hereafter. Moreover, alternative embodiments may include more or less steps than are shown or described herein and may include these steps in a different order than the order described in the following embodiments.

The method 500 starts at step 502. At step 504, the method 500 may include obtaining, by the processor 234, the vehicle information from the vehicle control unit 224. At step 506, the method 500 may include determining, by the processor 234, real-time vehicle operational parameters based on the vehicle information. In addition, as described above, the processor 234 may determine the vehicle type (i.e., whether the vehicle is an EV or an ICE vehicle) based on the vehicle information, the powertrain architecture type or vehicle type information that may be pre-stored in the memory 236.

At step 508, the method 500 may include determining, by the processor 234, that a predefined condition may be met based on the vehicle type and the real-time vehicle operational parameters, as described above. At step 510, the method 500 may include controlling, by the processor 234, air compressor operation based on the vehicle type and the real-time vehicle operational parameters, responsive to a determination that the predefined condition may be met.

The method 500 may end at step 512.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description and claims refer to particular system components. As one skilled in the art will appreciate, components may be referred to by different names. This document does not intend to distinguish between components that differ in name, but not function.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Computing devices may include computer-executable instructions, where the instructions may be executable by one or more computing devices such as those listed above and stored on a computer-readable medium.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A method to control operation of an air compressor of an electric vehicle, the method comprising:

obtaining, by a processor, vehicle information from the electric vehicle, wherein the vehicle information comprises real-time vehicle operational parameters;

determining, by the processor, that a predefined condition is met based on a determination that the electric vehicle is connected to an electric charger that is external to the electric vehicle;

controlling an air compressor operation to fill an air storage tank of the electric vehicle with compressed air to a maximum storage tank capacity of the air storage tank responsive to determining that the electric vehicle is connected to the electric charger;

determining, by the processor, that the electric vehicle is no longer connected to the electric charger that is external to the electric vehicle; and controlling the air compressor operation to fill the air storage tank of the electric vehicle to a level sufficient for operating a tool using compressed air from the air storage tank responsive to determining that the electric vehicle is no longer connected to the electric charger, wherein the level is less than the maximum storage tank capacity.

2. The method of claim 1 further comprising:

obtaining an air compressor activation request;

responsive to obtaining the air compressor activation request, determining that the predefined condition is met when a vehicle battery state of charge (SoC) is less than a predefined SoC threshold, based on the real-time vehicle operational parameters; and causing the air compressor to fill an air storage tank of the electric vehicle with compressed air at a second predefined pressure responsive to determining that the vehicle battery SoC is less than the predefined SoC threshold.

* * * * *